US005845448A

United States Patent [19]

Potvin

[11] Patent Number: 5,845,448

[45] Date of Patent: Dec. 8, 1998

[54] MASONRY BLOCK ASSEMBLY

[76] Inventor: Philip N. Potvin, P.O. Box 609, Cadillac, Mich. 49601

[21] Appl. No.: 833,832

[22] Filed: Apr. 10, 1997

[51] Int. Cl.[6] ..... E04B 2/30

[52] U.S. Cl. ..... 52/563; 52/562; 52/568; 52/426; 52/428; 52/582.1; 52/379; 52/565

[58] Field of Search ..... 52/562–564, 568, 52/426, 428, 438, 442, 699, 582.1, 389.11, 389.12, 465.1, 379, 565; 249/33, 38, 213

[56] References Cited

U.S. PATENT DOCUMENTS

| | | | |
|---|---|---|---|
| 994,027 | 5/1911 | O'Beirne | 52/568 X |
| 1,384,003 | 7/1921 | Thompson | 52/568 |
| 2,316,819 | 4/1943 | Tedrow | 25/564 |
| 2,326,361 | 8/1943 | Jacobson | 52/568 X |
| 2,647,392 | 8/1953 | Wilson | 52/563 |
| 4,055,928 | 11/1977 | Magerle | 52/405.1 |
| 4,483,115 | 11/1984 | Schoenfelder | 52/405.1 X |
| 4,584,043 | 4/1986 | Riefler | 52/405.1 X |
| 4,745,720 | 5/1988 | Taylor | 52/563 X |
| 4,884,382 | 12/1989 | Horobin | 52/426 |
| 5,291,711 | 3/1994 | Kopaz | 52/564 X |
| 5,459,970 | 10/1995 | Kim | 52/405.1 X |

FOREIGN PATENT DOCUMENTS

| | | | |
|---|---|---|---|
| 69116 | 1/1983 | European Pat. Off. | 52/405.1 |
| 730009 | 5/1962 | France | 52/563 |

*Primary Examiner*—Robert Canfield
*Attorney, Agent, or Firm*—Douglas S. Bishop

[57] ABSTRACT

The invention consists of a pair of rectangular concrete facing connected to each other by two or more connecting cross members or webs. Each of the concrete facing members has parallel protrusions which are undercut next to the member and which are connected to the cross members by conforming each end of the connecting cross member to conform to the exterior shape of the corresponding protrusion. The invention permits easier stowage and shipment of the masonry blocks and permits on-site assembly, as well as decreasing thermal conductivity by utilization of non-masonry cross members. The cross members may be configured, or perforated, to allow utility or other service lines to be run horizontally through the walls constructed utilizing the invention.

11 Claims, 3 Drawing Sheets

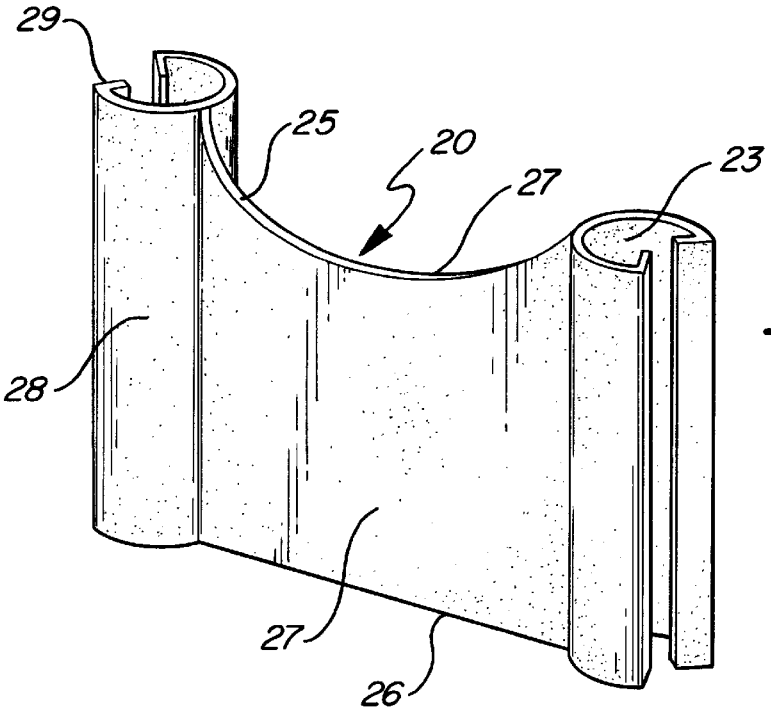
FIG-6
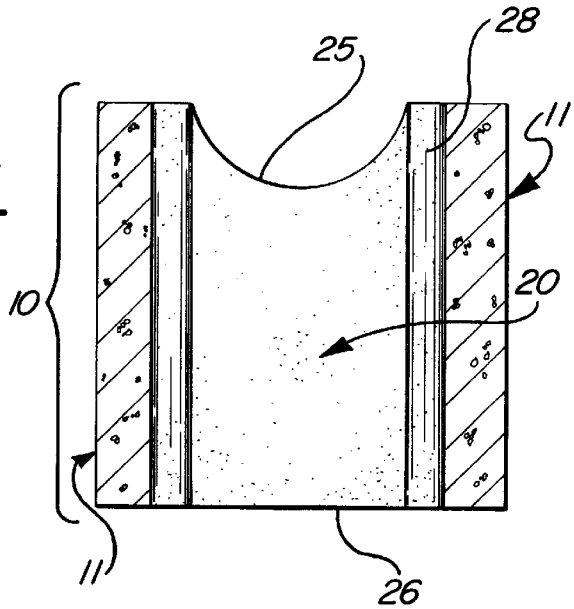
FIG-7
FIG-8
PRIOR ART
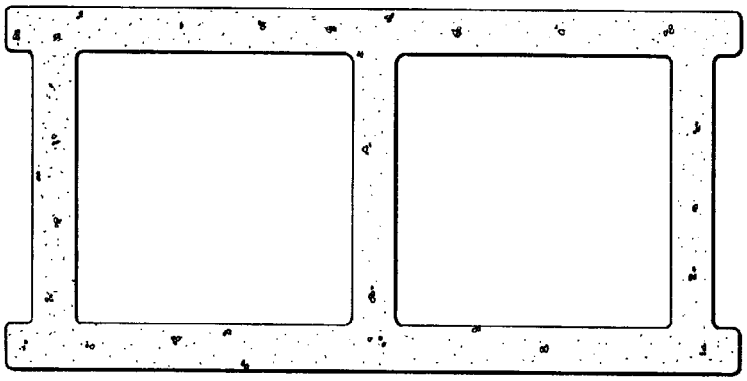

MASONRY BLOCK ASSEMBLY

BACKGROUND OF THE INVENTION

This invention relates to masonry blocks, and, more specifically, to masonry blocks which may be assembled utilizing non-masonry cross members which hold concrete masonry face members in parallel in a traditional masonry block arrangement.

The concept of a masonry block having corresponding masonry face members which are outwardly aligned in parallel and which have structural cross members between the parallel faces is known. Traditional concrete masonry blocks are of unitary construction, with the cross members and face members all formed of the same concrete material.

An important consideration in building materials, including masonry blocks, is thermal resistance. The thermal resistance of a particular material, masonry block, or masonry block assembly is a relative measure of how quickly the material, block, or assembly, will allow heat to pass through it. In building engineering terms, thermal resistance is referred to in terms of R-value. The more slowly that heat is allowed to pass through a material, the higher that material's thermal resistance is, and, correspondingly, the higher the R-value assigned to the material.

Traditional concrete masonry blocks have spaces between the cross members which may be filled with insulating material to increase the R-value of a wall or other structure constructed with such blocks. Such installation and applications, however, have no effect on the thermal resistance of the concrete cross members in traditional masonry blocks. Adaptations of traditional concrete masonry blocks have been made to facilitate insertion of foam or other insulation materials still utilizing a traditional block structure. An example of such an application is demonstrated by the ENERBLOCK (TM) of West Materials, Inc., Burnsville, Minn. Further examples of concrete masonry block applications are found in *The Portland Cement Association's Guide to Concrete Home Building Systems*, by Pieter A. VanDerwerf and W. Keith Munsel (McGraw-Hill, Inc. 1995).

The utilization of light weight concrete forms, and non-masonry connecting members for those forms, into which concrete is poured to form a central concrete core, is also known. U.S. Pat. No. 4,949,515, issued to Krecke, discloses a fastening element for sheeting and thermal insulation components. U.S. Pat. No. 4,885,888, issued to Young, discloses a synthetic plastic wall tie of variable lengths for use with concrete forms. U.S. Pat. No. 4,884,382, issued to Horobin, discloses a modular concrete block form which utilizes panel members and end enclosure panels to define a body cavity to receive poured concrete therein.

While the known prior art relates, in some respect, to construction of masonry walls, using masonry blocks, and to providing an ultimate wall of increased R-value, and, further relates, in some respects, to ease of assembly on site, at least with respect to masonry forms, which utilize non-masonry cross members, the prior art applications, relative to thermal conductivity considerations, still utilize concrete cross members, in traditional block assemblies, albeit, varying to some extent in shape and dimension. The prior art applications for utilization of cross members and forms, relate to poured masonry walls on site and do not relate to assembly on site of pre-cast masonry block elements.

As stated, traditional cement masonry building blocks, while of one-piece construction, essentially contain two separate classes of elements. Such blocks have external, generally rectangular face elements which, when utilized in construction, are generally laid end to end, and on top of each other in an essentially vertical plane, to maintain structural and load-bearing support. The additional class of elements in such blocks comprise the cross members, which are likewise constructed of concrete, in the one piece construction, and hold the face elements of the blocks together at a standard interval. They are not essential, however, for load-bearing stability once the blocks are in place.

Since traditional blocks are of one-piece construction, they must be transported, in finished form, from the point of fabrication to storage or sale facilities, and, ultimately, to the building site. Utilization of concrete cross members increases the weight of each individual unit, and the pre-formation requirement necessitates greater volume of storage and/or transportation requirements. The cost of storage, and/or transportation, is a substantial consideration in the masonry block industry. The manufacturer, distributor and builder incur considerable expense in storing and transporting the blocks, and moving the blocks on site. Any innovation in the field which allows for a decrease in the weight of the individual masonry block units without significantly decreasing load-bearing performance and allows for more units to be stored and/or transported, at the same, or lesser, cost, will result in significant cost savings and commercial advantage in the industry.

Further, any masonry block application which, in an assembled wall, will allow for a greater R-factor of the overall finished wall will result in lesser insulation requirements in the balance of the construction and will result in significant cost-savings and commercial advantage to the builder or, alternatively, if no additional insulation is added, in greater savings in cooling and/or heating costs to the owner of the completed structure.

Light-weight foam forms which are left in place to provide continuous insulation around a poured concrete core, require other external covering material if the external durability advantage of the concrete surface is to be duplicated. In standard applications, as well, utilities or service lines cannot be run within the external walls of the concrete shell when concrete is poured between the walls of a foam form.

Accordingly, a need exists for a masonry block assembly which does not sacrifice vertical load-bearing capacity; which provides for a traditional, two-sided, exterior masonry surface; which allows an overall thermal resistance of the interior wall greater than that of concrete; and which may, if appropriate, be assembled on site, to minimize handling, storage, and transportation costs.

Specifically, what is needed is a masonry block assembly which provides external concrete face elements connected by rigid non-masonry cross members capable of being used in the same manner as traditional concrete blocks, in the same manner as the referenced prior art; and which may be transported and stored as disassembled face elements and cross member elements, and assembled on site for use in construction applications. The needed device will also allow installation of additional insulation and utility or service lines between the exterior concrete facing surfaces.

SUMMARY OF THE INVENTION

This invention is directed to the provision of a masonry block assembly which will permit utilization of such masonry block assembly in the same manner, and providing the same outward appearance, as a standard, traditional concrete masonry block, but which will provide significant advantages with regard to thermal resistance, weight of the assembled block, and in minimizing transportation, storage, and movement-on-site requirements.

More specifically, this invention is directed to provision of a concrete masonry block assembly which presents rectangular outer concrete facing surfaces which provide the same appearance and surface integrity as traditional concrete blocks and which likewise provide the same structural, load-bearing capacity as a standard concrete block but which may be constructed using structural cross members or webs comprised of rigid, non-masonry materials, and which is lighter in weight than a traditional concrete block utilizing masonry cross members.

An additional object of the invention is to provide a masonry block assembly which will allow for a higher thermal resistance rating (R-factor) between the external face surfaces of the block.

An additional object of the invention is to provide a concrete masonry block assembly, in which the face members may be formed away from the building site and stored, transported to the building site, and moved about the building site, prior to formation of the completed block assembly, thereby reducing transportation and storage requirements.

According to another important feature of the invention, the rigid non-masonry connecting cross members of the block assembly may be conformed with apertures through their central portion, or may be conformed downwardly concave below the upper surfaces of the concrete facing members, to allow for passage of utility or service lines within the concrete shell of a wall to be formed by a combination of the block assembly.

According to a further feature of the invention, the cavity formed between the concrete facing members of the completed block assembly, when aligned in a wall or structural configuration may be filled with foam, or other insulation to further increase the thermal resistance rating of the completed wall or structure.

The above and additional features of the invention may be considered and will become apparent in conjunction with the drawings in particular, and the detailed description which follows.

BRIEF DESCRIPTION OF THE DRAWINGS

FIG. 6 is a perspective view of a connectible coupling member component of the invention showing a concave upper edge of the coupling member.

FIG. 7 is an end view of an assembled masonry block assembly showing the corresponding facing members and a connecting coupling member having a concave upper edge.

FIG. 8 is a top view of a traditional cement masonry block representative of the prior art.

DETAILED DESCRIPTION OF THE PREFERRED EMBODIMENT

Figure 1:
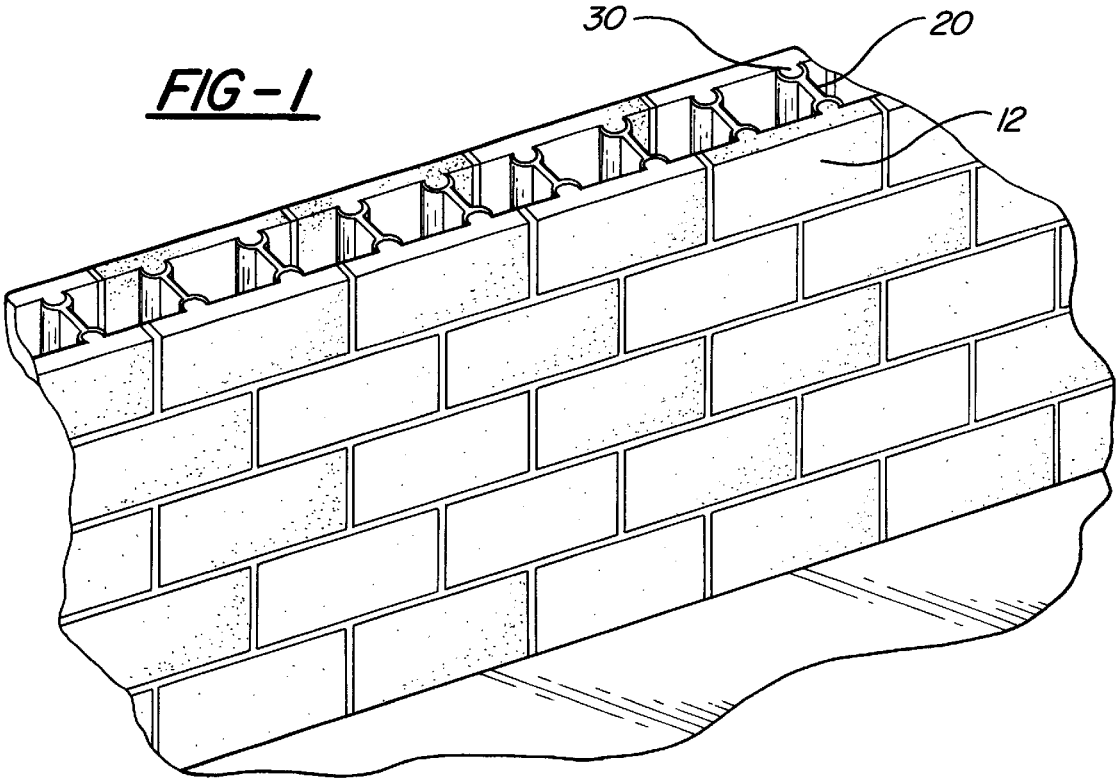
FIG. 1 is a perspective view of a section of masonry wall constructed utilizing the device.

The invention masonry block assembly, broadly considered, includes, when assembled, a block assembly 10. Said block assembly further consists of a pair of corresponding masonry face members 11. Each of the masonry face members 11 has an outer planar surface 12, an opposing inner surface 13, an upper surface edge 14, a lower surface edge 15 and two end surface edges 16.

The block assembly 10, further consists of two or more connectible coupling members 20. The coupling members 20 are mounted in parallel, as shown in FIG. 1 and FIG. 2 between the corresponding masonry face members 11, perpendicular to both the outer planar surfaces 12 and the inner surfaces 13 of the face members 11.

Each coupling member 20 has a length-wise dimension 21 and a pair of outwardly extending ends 22. The outwardly extending ends 22 of the coupling member 20 are affixed to the opposing inner surfaces 13 of the corresponding facing members 11. In one embodiment of the invention masonry block assembly 10 the outwardly extending ends 22 are affixed to the opposing inner surface by a commercial adhesive or other adhesive means.

Figure 2:
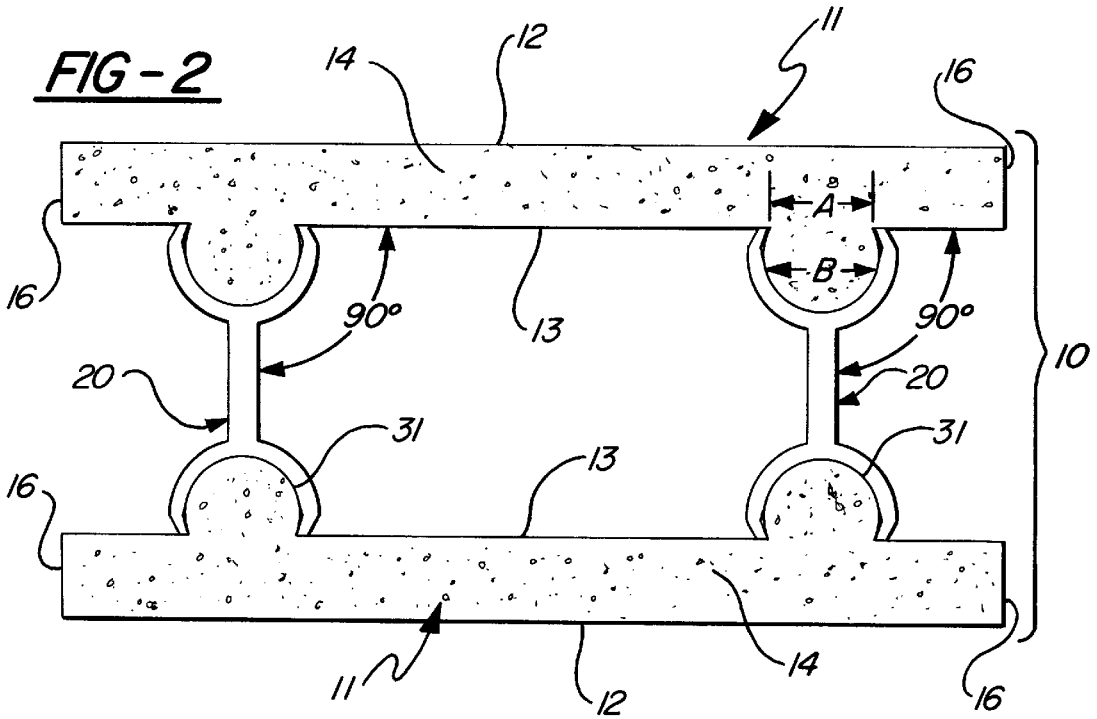
FIG. 2 is a top view of the device masonry block assembly, as assembled.
Figure 3:
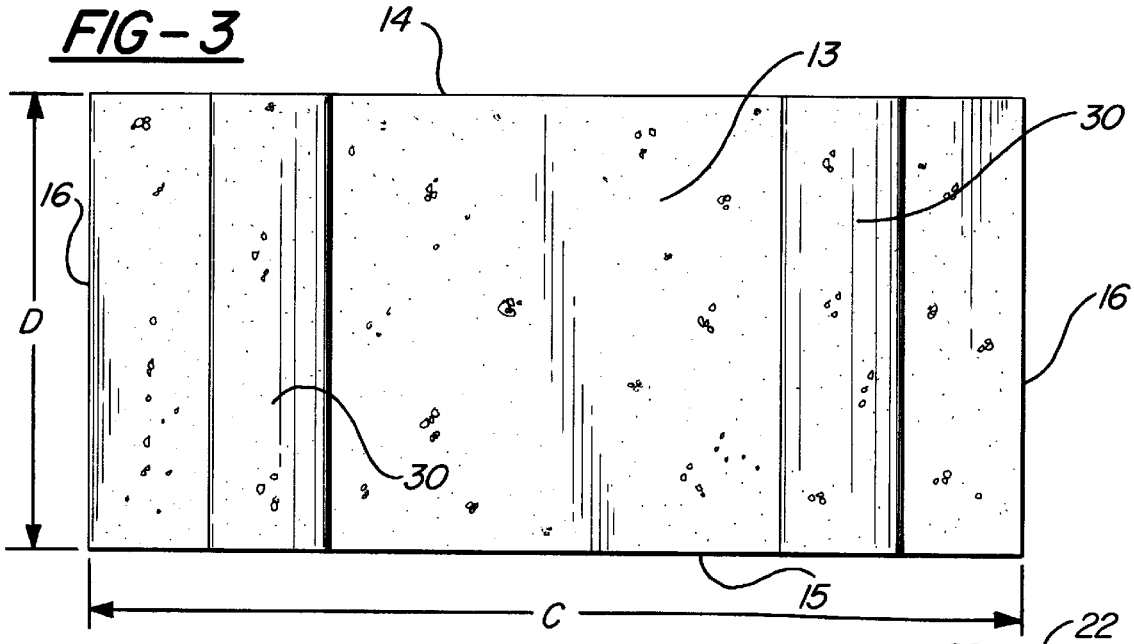
FIG. 3 is a side view of the inner surface of a masonry facing member component of the invention.

In the preferred embodiment of the invention each face member 11 has two or more ridges or protrusions 30, which, as shown in FIG. 2 and FIG. 3, are parallel and extend between the upper surface edge 14 and lower surface edge 15 on the opposing inner surface 13 of each face member 11. The parallel protrusions 30 on each of the opposing surfaces 13 correspond.

Each protrusion 30 is undercut so that when viewed from the upper surface edge 14, as shown in FIG. 2, each protrusion 30 has a narrower dimension A in closer proximity to the inner surface 13 than at its widest dimension B. Such dimensions are measured in parallel with the length-wise dimension of the upper surface edge 14 between the end surface edges 16. The outwardly extending ends 22 of the coupling member 20 are conformed to engage the convex outer surface 31 of the parallel protrusions 30. Each of the extending ends 22 of the coupling member 20 is concave 23, in general conformity with the convex outer surface 31 of the parallel protrusions 30.

Figure 5:
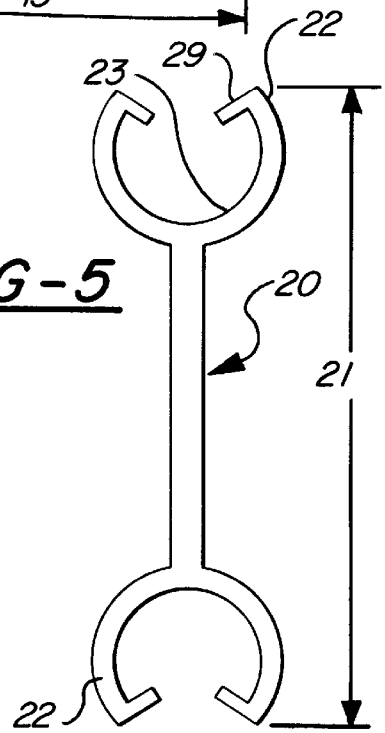
FIG. 5 is a top view of a connectible coupling member component of the invention.
Figure 4:
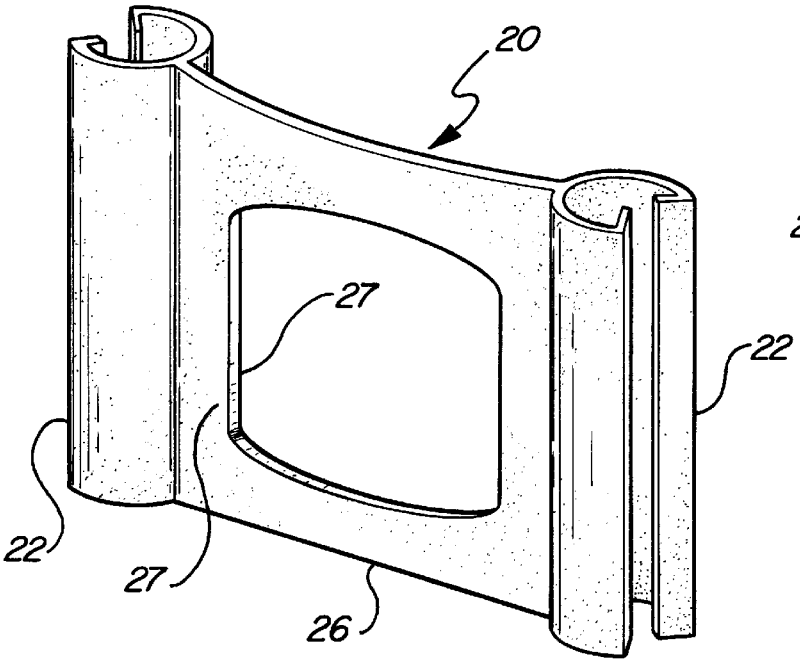
FIG. 4 is a perspective view of a connectible coupling member component of the invention showing an aperture for utility installation.

In the preferred embodiment of the invention, the coupling member 20 is generally planar as shown FIGS. 4, 5, and 6. Said planar coupling member has an upper edge 25, a lower edge 26 and two opposite outer planar surfaces 27 extending between upper edge 25 and lower edge 26. The extending ends 22 are concave 23 forming a partial concave cylinder 28, conforming with the convex outer surface 31 of the parallel protrusions 30.

In a further preferred embodiment of the invention the coupling member 20 defines an aperture 40 extending between the two outer planar surfaces 27 which sufficient to allow utility or other service lines to pass through the block assembly 10, as shown in FIG. 4. This feature is further provided for by the preferred embodiment of the coupling member 20 as shown in FIGS. 6 and 7, wherein the upper edge 25 of the coupling member 20 is downwardly concave and the upper edge 25 of each coupling member 20 at its outwardly extending ends 22 corresponds with the upper surface edge of each of the corresponding face members 11, and the lower edge 26 corresponds with the lower surface edge of each corresponding face member 11.

In another preferred embodiment of the invention, the coupling member 20 is comprised of rigid non-masonry, synthetic material.

In a further embodiment of the invention, the outwardly extending ends 22 of the coupling member 20 are comprised of resistably resilient material to ensure continued engagement between the convex outer surface 31 of the parallel protrusions 30 and the concave 23 extending ends 22 of the coupling member 20.

In another preferred embodiment of the invention, the exterior dimension of each facing member 10 is rectangular in nature with the rectangular dimension C between the two end surface edges 16 being greater than the rectangular dimension D between the upper surface edge 14 and lower surface edge 15.

WHEREAS, a preferred embodiment of the invention has been illustrated and described in detail, it will be apparent that various changes may be made in the disclosed embodiment without departing from the spirit of the invention.

What is claimed is:

1. A masonry block assembly comprising a pair of corresponding masonry facing members aligned in parallel, said facing members each further comprising an outer planar surface, an opposing inner surface, an upper surface edge, a lower surface edge and two end surface edges;

a plurality of connectible coupling members, said coupling members each comprising a length-wise dimension and two outwardly extending ends, said coupling members being mounted in parallel, between said corresponding facing members, perpendicular to the outer and inner surfaces of said facing members; and the opposing inner surfaces of the facing members each comprising a plurality of corresponding parallel protrusions, extending between the upper surface edge and lower surface edge of each inner surface;

each said protrusion having an outer surface varying in width, when viewed from the upper surface edge being narrower in closer proximity to the inner surface of the facing member than at its widest dimension;

the outwardly extending ends of each connectible coupling member being conformed to engage the outer surfaces of the corresponding parallel protrusions;

said connectible coupling members each further comprise an upper edge, a lower edge, and two outer planar surfaces extending between said upper edge and lower edge; and each connectible coupling member further defines an aperture extending between the outer planar surfaces.

2. A masonry block assembly comprising a pair of corresponding masonry facing members aligned in parallel, said facing members each further comprising an outer planar surface, an opposing inner surface, an upper surface edge, a lower surface edge and two end surface edges;

a plurality of connectible coupling members, said coupling members each comprising a length-wise dimension and two outwardly extending ends, said coupling members being mounted in parallel, between said corresponding facing members, perpendicular to the outer and inner surfaces of said facing members; and the opposing inner surfaces of the facing members each comprising a plurality of corresponding parallel protrusions, extending between the upper surface edge and lower surface edge of each inner surface;

each said protrusion having an outer surface varying in width, when viewed from the upper surface edge being narrower in closer proximity to the inner surface of the facing member than at its widest dimension; and the outwardly extending ends of each connectible coupling member being conformed to engage the outer surfaces of the corresponding parallel protrusions; and said connectible coupling members each further comprise an upper edge, a lower edge, and two outer planar surfaces extending between said upper edge and lower edge; and the upper edge of each connectible coupling member, at its outwardly extending end, corresponds with the upper surface edges of the parallel facing members, with said upper edge of each connectible coupling member being downwardly concave between said facing members.

3. A masonry block assembly according to claim 1, wherein the outwardly extending ends of each of connectible coupling member further comprise a resilient means to maintain engagement with the outer surface of the corresponding parallel protrusions.

4. A masonry block assembly comprising:

a pair of corresponding rectangular masonry facing members aligned in parallel, said facing members each further comprising an outer planar surface, an opposing inner surface, an upper surface edge, a lower surface edge and two end surface edges;

said opposing inner surfaces each comprising a plurality of corresponding parallel protrusions extending between the upper surface edge and lower surface edge;

each said protrusion having an outer surface varying in width when viewed from the upper surface edge, being narrower in closer proximity to the inner surface of said facing member than at the widest dimension of said protrusion; and a plurality of connectible coupling members, each comprising a lengthwise dimension, two outwardly extending ends, an upper edge, a lower edge, and two outer planar surfaces extending between said upper edge and lower edge, and corresponding with said corresponding parallel protrusions;

the upper edge of each of the connectible coupling members, at its outwardly extending ends, corresponding with the upper surface edges of the parallel facing members with said upper edge of each connectible coupling member being downwardly concave between said facing members, and the outwardly extending ends of each connectible coupling member being conformed to engage the outer surfaces of the corresponding parallel protrusions.

5. A masonry block assembly according to claim 4, wherein said masonry facing members are comprised of concrete.

6. A masonry block assembly according to claim 4, wherein said connectible coupling members are comprised of non-masonry material.

7. A masonry block assembly according to claim 4, wherein said connectible coupling members are comprised of a rigid synthetic material.

8. A masonry block assembly according to claim 4, wherein the rectangular dimensions of said facing members between the two end surface edges is greater than the rectangular dimension of said facing members between the upper surface edge and lower surface edge.

9. A masonry block assembly according to claim 4, wherein each connectible coupling member further defines an aperture extending between the outer planar surfaces.

10. A masonry block assembly according to claim 4, wherein the outwardly extending ends of each connectible coupling member further comprise a resilient means to maintain engagement with the outer surface of the corresponding parallel protrusions.

11. A masonry block assembly according to claim 2, wherein the outwardly extending ends of each connectible coupling member further comprise a resilient means to maintain engagement with the outer surface of the corresponding parallel protrusions.

* * * * *